United States Patent [19]

Russell

[11] Patent Number: 4,519,177

[45] Date of Patent: May 28, 1985

[54] METHOD FOR REINFORCING TUBULAR DUCTS

[75] Inventor: Derek V. Russell, Timperley Nr Altrincham, England

[73] Assignee: Alphacrete Construction Linings (UK) Limited, Cheshire, England

[21] Appl. No.: 447,979

[22] Filed: Dec. 8, 1982

[30] Foreign Application Priority Data

Dec. 14, 1981 [GB] United Kingdom ..... 8137653

[51] Int. Cl.[3] ..... E04B 1/16

[52] U.S. Cl. ..... 52/745; 52/664; 264/32; 264/34; 264/36

[58] Field of Search ..... 52/600, 660, 662, 664, 52/745; 264/32, 34, 36; 249/11

[56] References Cited

U.S. PATENT DOCUMENTS

| | | | |
|---|---|---|---|
| 344,670 | 6/1886 | Morris | 52/662 |
| 791,076 | 5/1905 | Chenoweth | 52/662 X |
| 3,296,690 | 1/1967 | Barron | 52/664 X |
| 3,800,492 | 4/1974 | Oroschakoff | 52/664 X |
| 3,844,511 | 10/1974 | Tolliver | 52/664 X |
| 3,914,915 | 10/1975 | Van Schyndel | 52/664 |
| 4,264,542 | 10/1984 | Magnus | 264/32 |

OTHER PUBLICATIONS

"Sewer Renewal by Insertion with Nipak Polyethylene Pipe," May 9, 1973, Dallas, Texas.

"Updating Aging Sewers Without Trenching," by H. S. St. Onge, Jul., 1974, *Engineering and Contract Record.*

*Primary Examiner*—Carl D. Friedman

*Assistant Examiner*—Naoko N. Slack

*Attorney, Agent, or Firm*—Oblon, Fisher, Spivak, McClelland & Maier

[57] ABSTRACT

There is disclosed a method of reinforcing a tubular duct using a longitudinally flexible reinforcing member built up from a plurality of combined layers having interstices therein and formed from steel wire or similar material. The method involves arraying the member circumferentially inside the duct, securing the member against the wall of the duct, and applying concrete to the covered walls.

10 Claims, 11 Drawing Figures

METHOD FOR REINFORCING TUBULAR DUCTS

This invention concerns a reinforcing member of the kind (hereinafter termed of the kind referred to) which is suitable for incorporation in a reinforced concrete structure, particularly, though by no means exclusively, a lining for a brick-built sewer.

The network of sewers in many conurbations of most long-established industrial nations are causing serious problems. Most were constructed from brick many years ago and are now subject to failure and collapse, no doubt accelerated by the increase in heavy traffic using the roads, under which or beside which the sewers are located. Another problem is that many sewers are proving to have inadequate capacity both as a result of increasing population and increasing industrial activity with consequent increase in the volume of industrial effluent discharged to the sewers.

The present invention provides a novel reinforcing member of the kind referred to which is particularly suited for use in relining old brick-built sewers with a reinforced concrete shell, and if required one which replaces some or even all of the original brickwork, thus enabling an increase in the internal diameter of the sewer and hence increasing its capacity.

According to the present invention there is provided a reinforcing member of the kind referred to comprising a plurality of layers, each fabricated from steel or similar material and having a multiplicty of interstices therein, conjoined in superimposed relationship, the number and nature of the layers and the shape of tne member being such that it is flexible in at least one longitudinal direction.

Preferably the member will comprise outer layers having relatively large interstices enclosing inner layers having relatively small interstices.

The outer layers may, for example, comprise an array of spaced parallel wires in each of two directions welded together at the crossing points to form a mesh, whilst the inner layers may comprise a woven wire sheet.

The members may be of elongated rectangular or plank-like form or of more complex shape such as one which forms a helical tube, for example.

The invention also includes a method of producing the reinforcing members aforesaid.

The invention also includes a method of providing a lining to a structure, particularly a brick-built sewer, utilising the reinforcing members aforesaid.

The invention will be further apparent from the following description, with reference to the several figures of the accompanying drawings, which show, by way of example only, a number of reinforcing members embodying the invention and possible applications for same.

Figure 1:
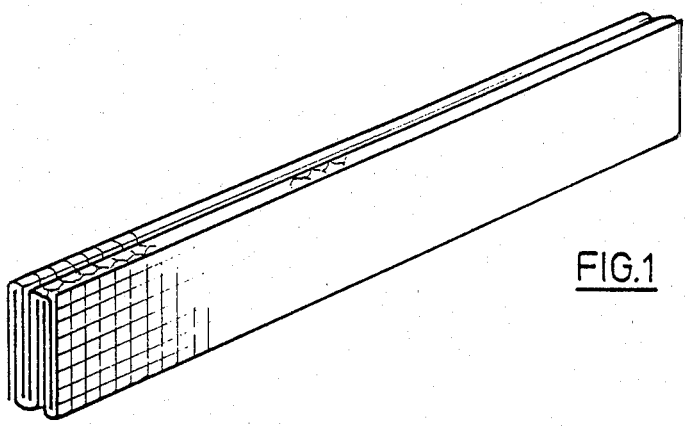
FIG. 1 shows a perspective view of a first form of member.
Figure 2:
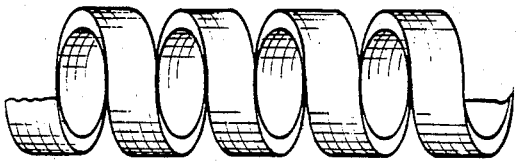
FIG. 2 shows a perspective view of a second form of member.

Referring first to FIGS. 1 and 2, it will be seen that the reinforcing members of the invention may take many different forms such as that of an elongated rectangular plank (FIG. 1) or a helix forming a tube (FIG. 2).

In all cases the members are comprised by a plurality of layers, each fabricated from steel or similar material so as to have a multiplicity of interstices therein, conjoined in superimposed relationship in substantially parallel planes and then subjected, if required, to secondary shaping as for example to form the helix of the member of FIG. 2.

Generally at least the opposed outer layers will have relatively large interstices, whilst some at least of the inner layers will have relatively small interstices.

Figure 3:
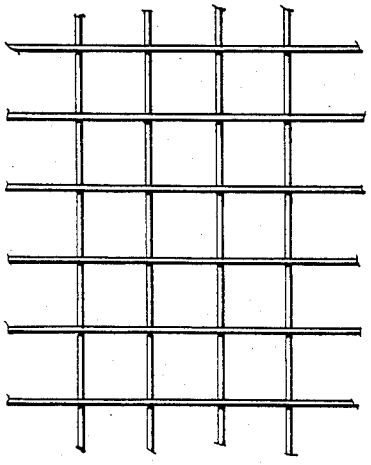
FIG. 3 shows one example of one kind of layer which might be included in the members of either FIG. 1 or FIG. 2.

The layers having relatively large interstices might be fabricated by two arrays of spaced parallel steel wires at an angle, usually 90°, to one another and welded together at each of the crossing points. Such a layer is illustrated in FIG. 3.

Figure 4:
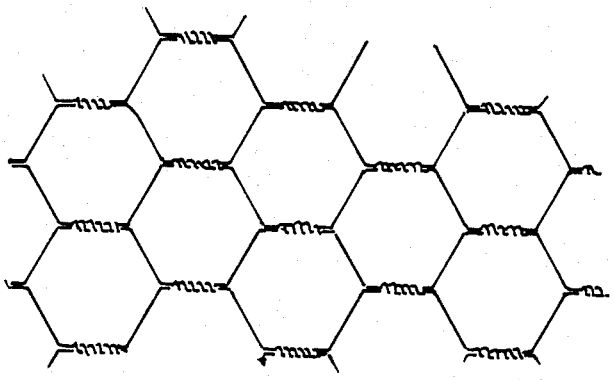
FIG. 4 shows one example of another kind of layer which might be included in the members of either FIG. 1 or FIG. 2.
Figure 5:
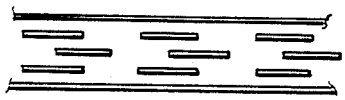
FIGS. 5 to 8 show possible combinations of the layers of FIGS. 3 and 4 to form the members of FIGS. 1 and 2.

The layers having relatively small interstices might be formed from a woven wire mesh. Such a layer is illustrated in FIG. 4.

The ways in which the different kinds of layer may be superimposed to form the members of FIGS. 1 and 2 are legion. Possible and preferred cross-sections for the members are shown in FIGS. 5 to 8, in each of which layers having relatively large interstices are indicated by full lines and layers having relatively small interstices are indicated by broken lines.

Figure 6:
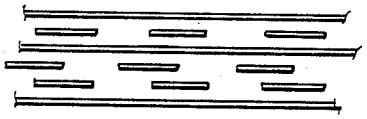
Figure 7:
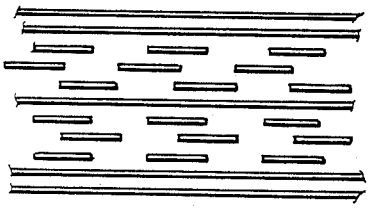
Figure 8:
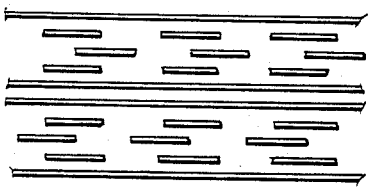

The cross-section of FIG. 6 is particularly interesting, since it arises from a preferred method for producing the reinforcing members, wherein a layer having relatively small interstices is laid on a layer having relatively large interstices and wherein the assembly is folded inwardly along two longitudinally extending axes which divide the width of the assembly into three equal parts.

This method of production involving superimposing layers and folding may be practised with more than two layers which may be of like or unlike kind and with a single fold or more than two folds.

In every instance, the shape of the member and the number and construction of the layers from which it is formed are selected to ensure that the member is flexible in at least one longitudinal direction.

The members can be used to form the reinforcement for all manner of concrete structures such as tanks, reservoirs and so on, but they are particularly suitable for use in reinforcing concrete linings for old brick-built sewers, their flexibility enabling them to be introduced into the sewers through the manholes generally present in the sewer network.

Figure 9:
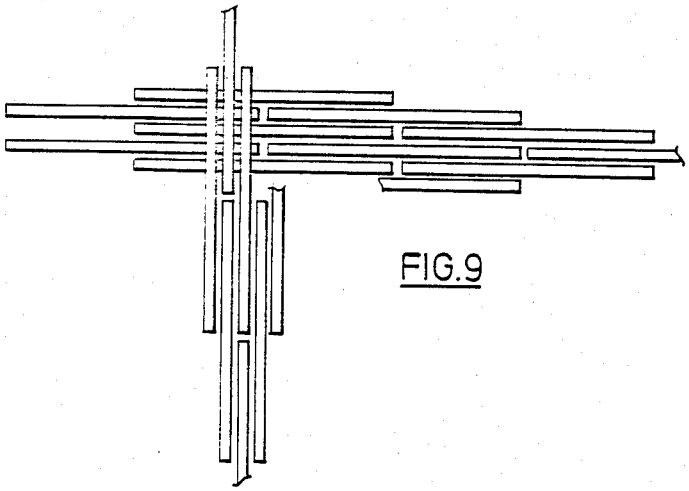
FIG. 9 shows how a plurality of the members of FIG. 1 might be arranged to form a lining to a brick-built, sewer of large diameter.

For example, the plank-like members of FIG. 1 can be laid over the old brickwork within a sewer in each of two directions as shown in FIG. 9. Those passing around the circumference of the sewer can be of such length and flexibility that a single such member can exactly circumscribe the internal periphery of the sewer. The members are secured in position by nails or other mechanical fixing means, before being embedded in a mortar which can be sprayed, hand-laid or otherwise applied, preferably under pressure, so as to completely fill the voids of the reinforcing members and penetrate same to fill apertures in the old brickwork and thus key the new lining to the old.

The mortar may contain desired additives for quick hardening (when a sewer cannot be out of commission for any prolonged period), to overcome corrosion problems, to provide a surface which can be polished or which will accept a further coating, for example.

Figure 10:
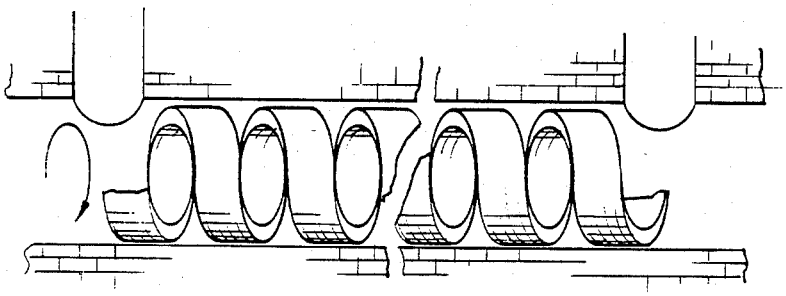
FIG. 10 shows how the member of FIG. 2 might be positioned to form a lining in a sewer of relatively small diameter.

The member of FIG. 2 may be of such diameter that it can readily be positioned by threading into a sewer of relatively small diameter (see FIG. 10) and then expanded by rotating one end relative to the other to press against the sewer walls prior to embedding in mortar by remotely controllable mechanical means.

If necessary, some or all of the old brickwork can be removed from a sewer before fitting the reinforcing members by use of suitable supporting structures, thus enabling the diameter of a sewer to be increased.

Figure 11:
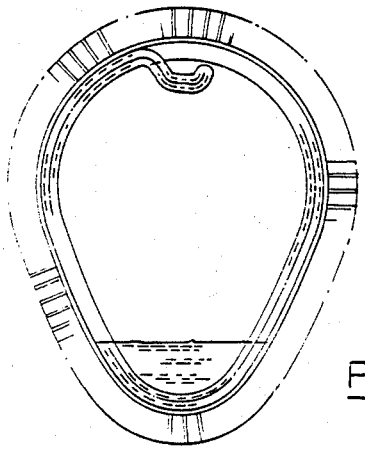
FIG. 11 shows a cross-section through a brick-built sewer which has been relined in accordance with the invention, and in such a manner as to provide a trough for cables running along the top of the sewer.

As best seen from FIG. 11 wires from the members can be bent downwardly and plastered over to define a longitudinally extending shelf or trough for cables, such as those required for cable TV for example, thus enabling their installation at modest cost. By locating the shelf or trough at the top of the sewer it is ensured that the cables are dry for the majority of their lives, only becoming wet on the rare occasions that the sewer carries full bore flow. As an alternative a pre-formed shelf or trough member may be secured to the reinforcing members before the plastering operation. In either case the shelf or trough is integral with the sewer lining.

It will be appreciated that it is nor intended to limit the invention to the above example only, many variations, such as might readily occur to one skilled in the art, being possible, without departing from the scope thereof.

Typical reinforcing members of plank-like form will have lengths in the range of from 2–4 meters, and widths in the range of from 30–60 centimeters. The relatively large interstices may be 2.5 to 5.0 cm across and the relatively small interstices may be 1.0 cm across.

I claim:

1. A method for reinforcing the walls of tubular ducts such as serers comprising introducing into the duct elongate board-like longitudinally flexible reinforcement members each comprising at least one layer of a first material having large interstices and at least one layer of a second material having relatively small interstices and arraying said members circumferentially inside the duct to form a tubular reinforcement covering the walls of the duct, securing said member against the wall of the duct and applying concrete to said covered walls whereby to provide a reinforced concrete lining to said duct.

2. A method according to claim 1 in which said first material comprises an array of spaced parallel wires extending in two directions so as to have crossing points and welded together at said crossing points to form a welded mesh.

3. A method according to claim 1 in which said second material comprises woven wire.

4. A method according to claim 1 in which said member comprises outer layers of said first material.

5. A method according to claim 1 in which said member comprises sheets of said first and second materials having a first width and said member has a second width narrower than said first width said sheets being folded so as to provide more than one layer each of said first and second materials in said board-like member.

6. A method according to claim 1 in which in addition to arraying said reinforcement members circumferentially inside the duct, other similar reinforcement members are arranged lengthwise of the duct.

7. A method according to claim 1 in which a plurality of such other similar reinforcement members is arranged each extending lengthwise of the duct to form a partial or complete lining of the duct.

8. A method according to claim 1 in which said reinforcement members are arranged helically in said duct.

9. A method according to claim 1 in which existing duct lining is at least partially removed before introducing said reinforcement members.

10. A method according to claim 1 in which material from at least one layer of at least some of said reinforcement member is fashioned into cable support means in the upper region of the duct.

* * * * *

UNITED STATES PATENT AND TRADEMARK OFFICE

CERTIFICATE OF CORRECTION

PATENT NO. : 4,519,177

DATED : MAY 28, 1985

INVENTOR(S) : DEREK V. RUSSELL

It is certified that error appears in the above-identified patent and that said Letters Patent is hereby corrected as shown below:

Column 1, line 33, change "tne" to --the--.

Column 4, line 5, change "serers" to --sewers--.

Signed and Sealed this

*First* Day of *October 1985*

[SEAL]

*Attest:*

DONALD J. QUIGG

*Attesting Officer*

*Commissioner of Patents and Trademarks—Designate*